US006796771B2

(12) United States Patent
Suzuki

(10) Patent No.: US 6,796,771 B2
(45) Date of Patent: Sep. 28, 2004

(54) AXIAL-FLOW FAN

(75) Inventor: Tetsunobu Suzuki, Numazu (JP)

(73) Assignee: Usui Kokusai Sangyo Kaisha Limited, Shizuoka (JP)

( * ) Notice: Subject to any disclaimer, the term of this patent is extended or adjusted under 35 U.S.C. 154(b) by 0 days.

(21) Appl. No.: 10/365,757

(22) Filed: Feb. 12, 2003

(65) Prior Publication Data

US 2003/0156945 A1 Aug. 21, 2003

(30) Foreign Application Priority Data

Feb. 15, 2002 (JP) ..... 2002-38580

(51) Int. Cl.[7] ..... F04D 29/38
(52) U.S. Cl. ..... 416/228; 416/235; 416/237
(58) Field of Search ..... 416/228, 235, 416/237

(56) References Cited

U.S. PATENT DOCUMENTS 4,664,593 A * 5/1987 Hayashi et al. ..... 415/119
5,215,441 A * 6/1993 Evans et al. ..... 416/223 R
5,226,783 A * 7/1993 Mita ..... 416/223 R

FOREIGN PATENT DOCUMENTS

JP 4-86399 3/1992
JP 2002-242886 8/2002

* cited by examiner

*Primary Examiner*—Ninh H. Nguyen
(74) *Attorney, Agent, or Firm*—Gerald E. Hespos; Anthony J. Casella

(57) ABSTRACT

An axial-flow fan having a high fan efficiency and high performance is provided by improving a fluid flow on the rear edge side of a blade tip without deteriorating the fluid flow on the front side of the blade tip, and reducing loss of horsepower without causing a large influence on loadings. The blade has a warped portion on the side surface of the blade tip on the rear edge side thereof, being formed by bending the blade tip toward upstream at angles between 5 to 30 degrees with a smooth filet R along a line C connecting a position along the blade tip at the chord length A to 1/5 A from the rear edge of the blade tip toward the front edge of the blade tip and a position along the radial length B of the blade at 1/2B to 1/10B from the rear edge of the blade tip.

1 Claim, 6 Drawing Sheets

AXIAL-FLOW FAN

BACKGROUND OF THE INVENTION

1. Field of the Invention

The present invention relates to an axial-flow fan to be directly driven by a drive shaft of an internal combustion engine, or indirectly driven by means of belt driving, hydraulic driving, motor driving and so on, and, more specifically, to an axial-flow fan in which a fluid flow at a fan blade tip is improved.

2. Description of the Related Art

The axial-flow fan of this type includes a boss member to be directly or indirectly driven by the drive shaft of the internal combustion engine, a hydraulic motor, an electric motor and the like, and a fan blade attached on the periphery of the boss member. The fan blade generates a fluid flow when the boss member is rotated. The fan blade is generally curved into a vane-shape for raking out fluid effectively. Therefore, in the case of the axial-flow fan having such a fan blade, there is a problem in that the fluid passed through the fan flows upstream of the fan and lowers the efficiency of the fan. Therefore, in order to prevent such phenomenon that the fluid passed through the fan flows upstream of the fan, there is proposed an axial-flow fan in which a flow at the fan tip is improved (JP-A-4-86399).

This axial-flow fan includes a substantially triangular centrifugal component element extending substantially in parallel with the plane including an axis of the fan formed integrally on the side of the fan blade. With such centrifugal component element, a part of the fluid passed through the fan flows radially, and the radial flow forms a barrier for air, so that the fluid is prevented from flowing around to the front side of the fan.

Therefore, since the axial-flow fan having the centrifugal component element includes the substantially triangular centrifugal component element formed by bending a part or the entire part of the fan blade tip toward upstream, a fluid flow on the rear edge side of the blade tip is improved. However, there remains a problem in that the fluid flow is not improved over the entire range of air quantities. In addition, in recent years, high loadings in the axial-flow fan are increasingly required in association with increase in horsepower of the internal combustion engine, and thus horsepower consumption tends to increase. When the horsepower consumption increases, a load applied on the fan drive inevitably increases correspondingly. As a consequent, a fan of high loadings and of lower horsepower is required.

In view of such circumstances, the invention is intended to improve a fluid flow on the rear edge side of the blade tip without deteriorating the fluid flow on the front edge side of the blade tip, reduce loss of horsepower without causing a large influence on the loadings, and provide an axial-flow fan having a high fan efficiency and a high performance.

SUMMARY OF THE INVENTION

The axial-flow fan according to the invention is characterized in that the blade has a warped portion on the side surface of the blade tip on the rear edge side thereof, the warped portion is formed by bending the blade tip toward upstream at angles between 5 to 30 degrees with a smooth filet R along a line connecting a widthwise position along the blade tip at a length between A and 1/5A, where A represents the chord length A, from the rear edge toward the front edge thereof and a radial position of the rear edge of the blade tip at a radial length between 1/2B and 1/10B from the rear edge of the blade tip, where B represents the radial length of the blade.

DETAILED DESCRIPTION OF PREFERRED EMBODIMENTS

Figure 1:
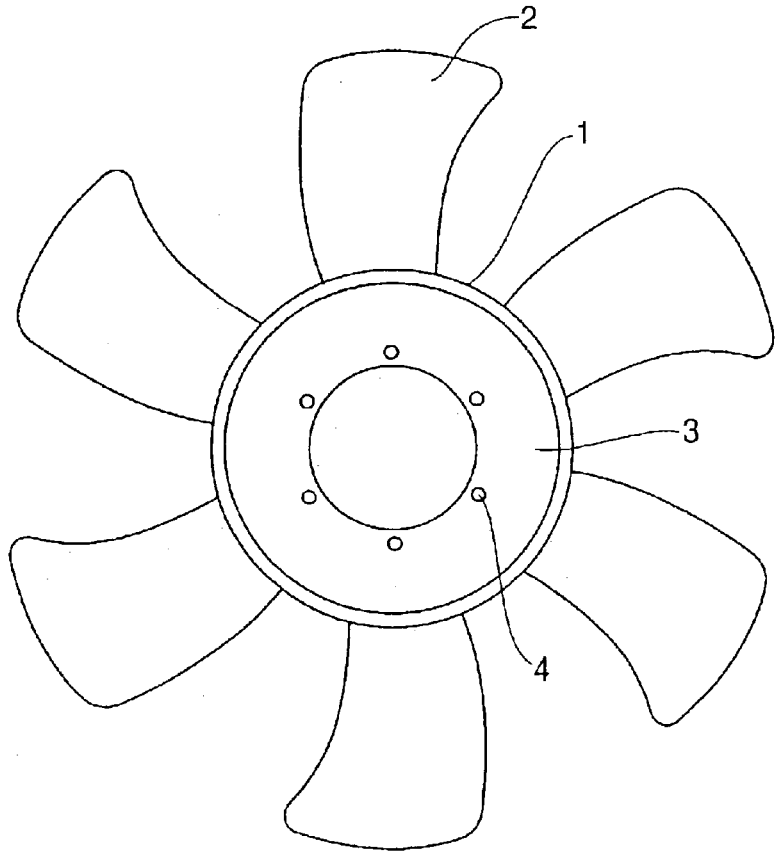
FIG. 1 is a front conceptual view of the axial-flow fan according to an embodiment of the invention.

In the invention, reference numeral 1 designates a boss member, numeral 2 designates a fan blade, numeral 2*a* designates a warped portion, numeral 3 designates a steel insert, numeral 4 designates a mounting hole, reference sign A designates a chord length of the blade tip, reference sign A' designates a length of the warped portion ranging from A to 1/5A extending from the rear edge side of the blade tip toward the front edge side of the blade tip, reference sign B designates a radial length of the blade, reference sign B' designates a length of the warped portion ranging from 1/2B to 1/10B extending radially from the rear edge of the blade tip, reference sign α designates a widthwise position of A', reference sign β designates a radial position of B', reference sign C designates a line connecting α and β, and reference sign θ designates a warped angle of a warped portion 2*a* of the blade.

Figure 2:
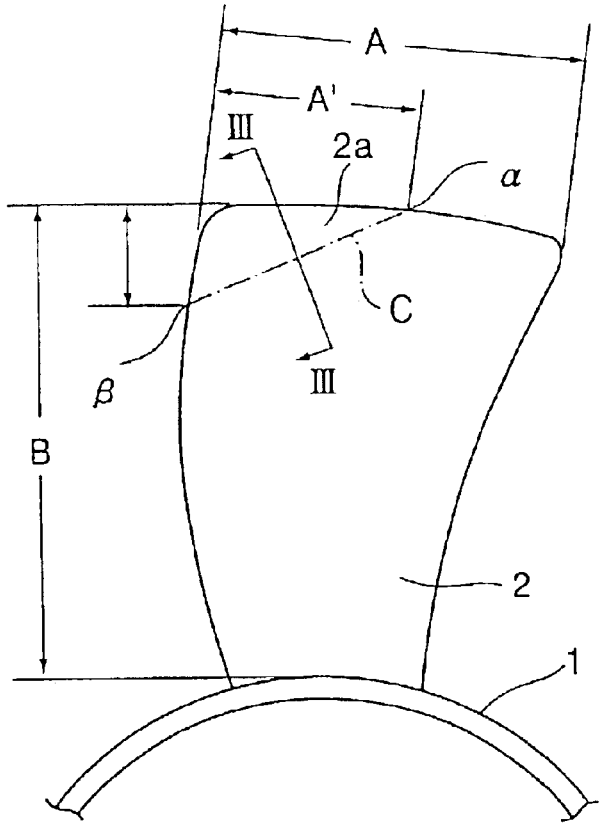
FIG. 2 is an enlarged front conceptual view showing a part of the blade of the same axial-flow fan.
Figure 3:
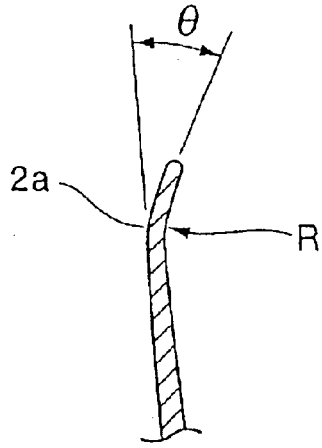
FIG. 3 is a cross sectional view taken along the line III—III in FIG. 2.
Figure 4:
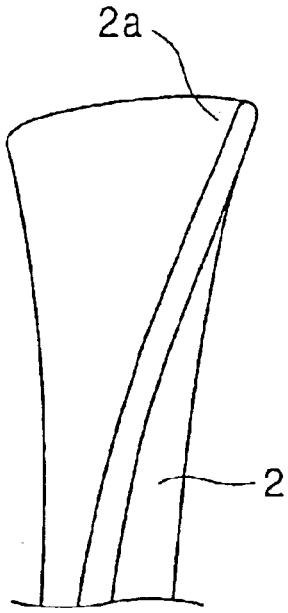
FIG. 4 is a side conceptual view of the fan blade shown in FIG. 2 when viewed from the rear edge side.
Figure 5:
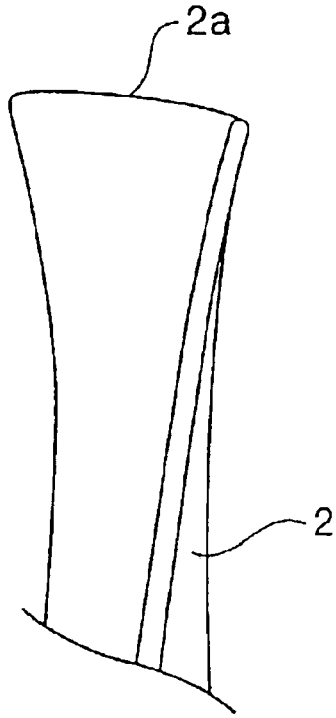
FIG. 5 is a side conceptual view of the same fan blade shown in FIG. 2 from the front edge side.

In other words, the axial-flow fan according to the invention includes a plurality of plastic fan blades 2 integrally formed on the outer periphery of a plastic boss member 1 having a circular steel insert 3 formed with a mounting hole 4 on the periphery thereof and embedded therein, and includes a warped portion 2*a* on the side surface of the rear edge side of the blade tip. The warped portion 2*a* is, as shown in FIGS. 2 and 3, formed by bending the blade along a line C connecting a widthwise position α at the length A', which corresponds to the length between A and 1/5A, from the rear edge of the fan blade 2 tip toward the front edge thereof and a radial position β at the length B', which corresponds to 1/2B to 1/10B from the rear edge of the fan blade 2 tip, at a warped angle of θ=5 to 30 degrees with a smooth fillet R toward upstream. Though the fillet R may vary depending on the size of the blade, thickness of the vane, the camber, and the like, the fillet is preferably formed continuously and smoothly so as not to disconnect the fluid flow at the bent portion, and has a dimension that does not cause concentration of stress as a condition.

In the invention, the reason why the conditions of the warped portion 2*a* formed on the side surface of the blade tip on the rear edge side include that the warped portion 2 is formed on the line C connecting the widthwise position α at the length A', which corresponds to the length between A and 1/5A, from the rear edge of the fan blade 2 tip toward the front edge thereof and the radial position β at a length B', which corresponds to the length between 1/2B and 1/10B, from the rear edge of the fan blade 2 tip, is as follows.

When A' is smaller than 1/5A, it is almost the same as the case where the blade is not bent, and thus no effects can be expected.

When B' is smaller than 1/10B, it is almost the same as the case where the blade is not bent, and thus no effects can be expected, while when it exceeds 1/2B, lowering of air quantity increases, and thus efficiency may lower.

The reason why the angle θ of warp of the blade tip is limited to the value between 5 to 30 degrees is that if it is less than 5 degrees, no effect is expected because it is almost the same as the case where the blade is not bent, and if it exceeds 30 degrees, the efficiency is lowered because the quantity of air decreases too much.

The fillet R is not specifically limited, but in the order of 5 mm is preferable.

Figure 6:
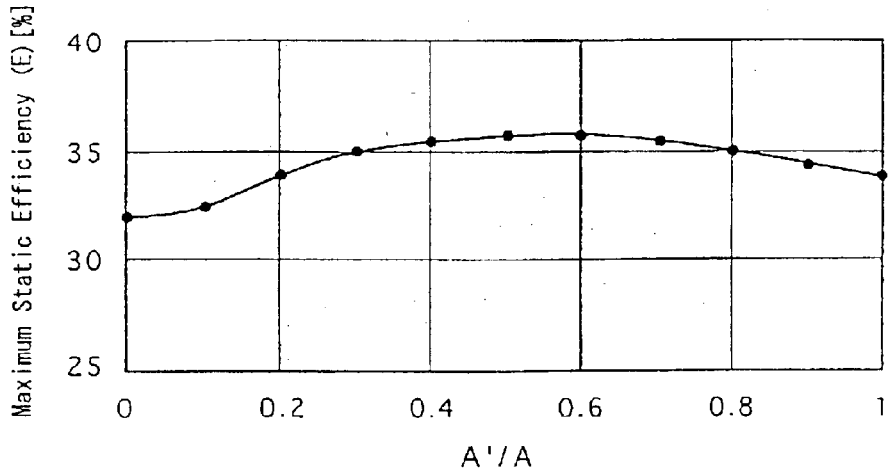
FIG. 6 is a graph showing a relation between the A'/A and the maximum static efficiency E in the case where B'=1/3B and θ=20° in the axial-flow fan according to the invention.
Figure 7:
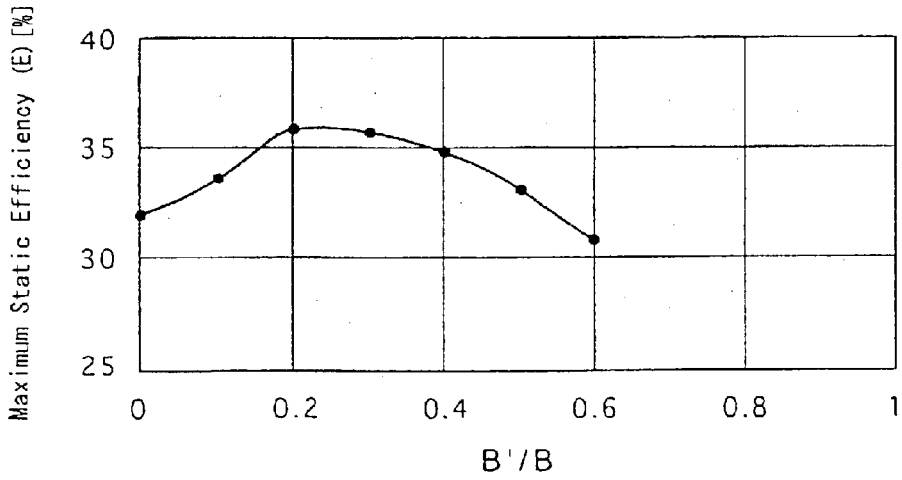
FIG. 7 is a graph showing a relation between B'/B and the maximum static efficiency E in the case where A'=1/2A and θ=20° in the axial-flow fan according to the invention.
Figure 8:
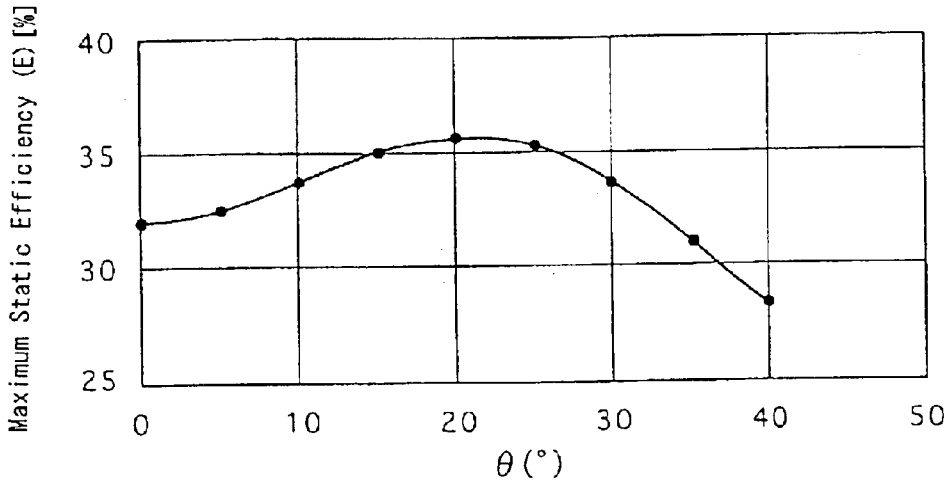
FIG. 8 is a drawing showing a relation between θ and the maximum static efficiency E in the case of 1/2A, 1/3B in the axial-flow fan according to the invention.

FIG. 6 to FIG. 8 are experimental data on maximum static efficiency of the fan blade according to the invention. FIG. 6 is a graph showing a relation between A'/A and the maximum static efficiency E in the case where B'=1/3B and θ=20°; FIG. 7 is a graph showing a relation between B'/B and the maximum static efficiency E in the case where A'=1/2A and θ=20°; and FIG. 8 is a drawing showing a relation between θ and the maximum static efficiency E in the case of 1/2A, 1/3B. As is clear from these data, the limited conditions of the warped portion in the invention are suitable.

Figure 9:
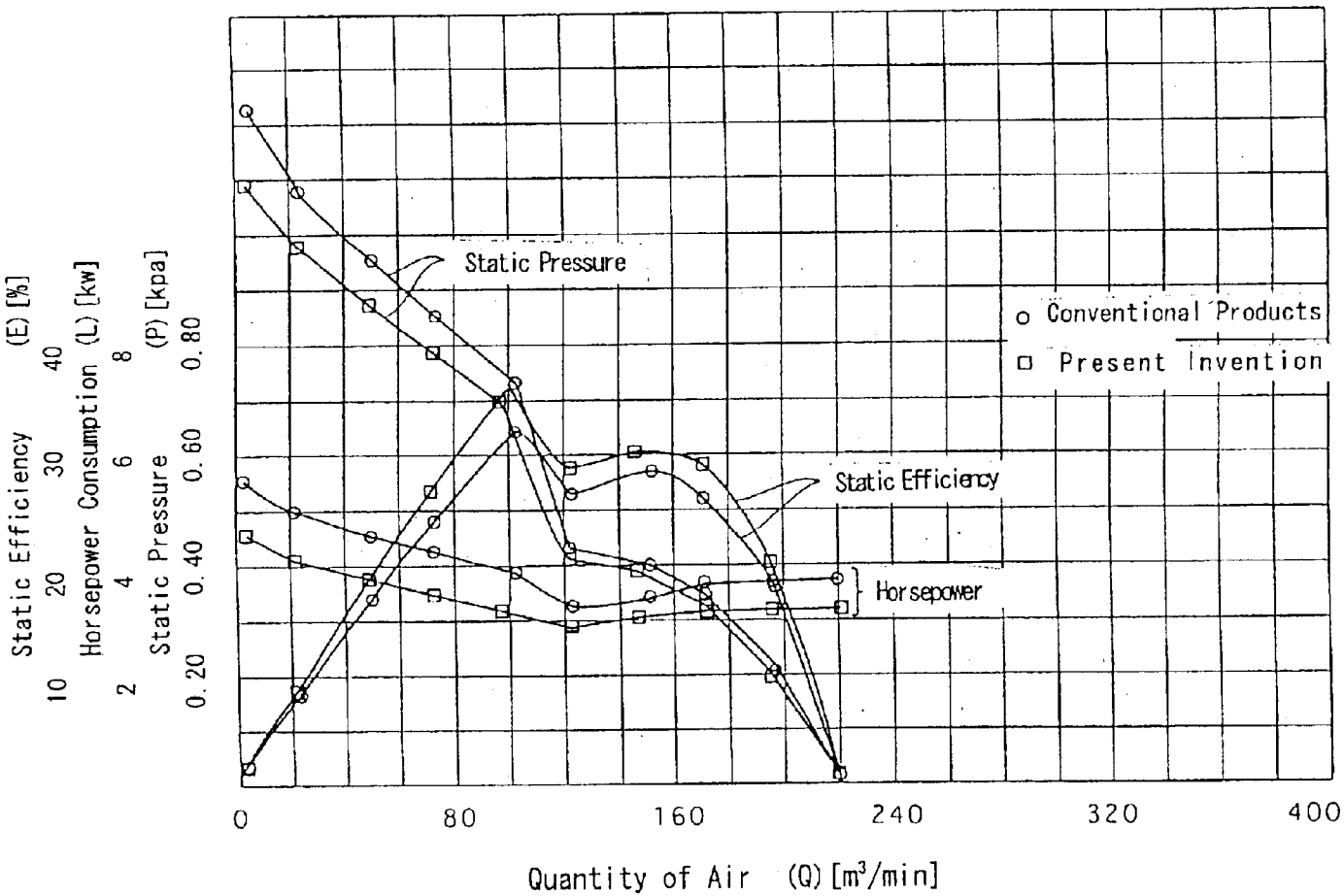
FIG. 9 is a drawing showing the static pressure P, the horsepower consumption L, and the static efficiency E with respect to the quantity of air Q according to the embodiment of the invention.

A static pressure P, a horsepower consumption L, and the static efficiency E of the axis-flow fan according to the invention with respect to the quantity of air Q are shown in FIG. 9 in comparison with the axial-flow fan of the related art having no warped portion. The selected axial-flow fan used in the present embodiment is such that the outer diameter of a boss is φ235 mm, a chord length of the blade tip A is 145 mm, the radial length of the blade B is 145 mm, and the number of blades is nine. The parameters of the axial-flow fan according to the invention are compared based on; A'=80 mm, B'=35 mm, θ=20°, fillet R=10 mm, and the number of revolution=2000 r/min.

It is clear from data shown in FIG. 9 that the axial-flow fan according to the invention is superior in all of the static pressure P, the horsepower consumption L, and the static efficiency E with respect to the quantity of air Q.

Although the blade-boss integrated fan is described in this example, it is needless to say that the sectional fan or the like disclosed in Japanese Patent Application No. 2000-402750 is also applicable.

As described thus far, according to the axial-flow fan of the invention, since the fluid flow on the rear edge side of the blade tip may be improved without causing deterioration of the fluid flow on the front edge side of the blade tip by forming a suitable warped portion on the rear edge side of the blade tip, a superior effect that the horsepower loss may be prevented without giving significant effect on the quantity of air.

What is claimed is:

1. An axial-flow fan comprising a plurality of fan blades disposed in a circumferential direction at desired intervals, characterized in that each said blade has a blade tip at an outer circumferential position of the respective blade, a front edge at a leading position with respect to a direction of rotation of the fan and rear edge at a trailing position with respect to the direction of rotation, each said blade further having a warped portion on the blade tip on the rear edge, the warped portion being formed by bending the blade tip toward upstream so that portions of the blade adjacent the blade tip are aligned to radially inner portions of the blade at angles between 5 and 30 degrees with a smooth filet (R) extending continuously along a line (C) connecting a width-wise position along the blade tip at a length between 0.8 A and 0.2A, where A represents a chord length from the rear edge toward the front edge thereof and a radial position on the rear edge of the blade at a radial length between 1/2B and 1/10B from the rear edge of the blade tip, where B represents the radial length of the blade.

* * * * *